US007773926B2

(12) United States Patent
Yoshiyama et al.

(10) Patent No.: US 7,773,926 B2
(45) Date of Patent: Aug. 10, 2010

(54) IMAGE FORMING APPARATUS

(75) Inventors: Tsugihito Yoshiyama, Toyohashi (JP); Munenori Nakano, Hoi-gun (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 95 days.

(21) Appl. No.: 11/711,108

(22) Filed: Feb. 27, 2007

(65) Prior Publication Data

US 2007/0212127 A1 Sep. 13, 2007

(30) Foreign Application Priority Data

Mar. 13, 2006 (JP) ..... 2006-067409

(51) Int. Cl.
*G03G 15/01* (2006.01)
*G03G 15/00* (2006.01)

(52) U.S. Cl. ..... 399/302; 399/396

(58) Field of Classification Search ..... 399/82, 399/85, 298, 299, 301, 302, 394, 396
See application file for complete search history.

(56) References Cited

U.S. PATENT DOCUMENTS 6,453,139 B2 * 9/2002 Sasame et al. ..... 399/167
6,766,124 B2 * 7/2004 Taguchi et al. ..... 399/66
7,130,549 B2 * 10/2006 Aono et al. ..... 399/45
7,215,907 B2 5/2007 Fukuchi et al.
2001/0008589 A1 7/2001 Sasame et al.

FOREIGN PATENT DOCUMENTS

JP 2001-201912 7/2001
JP 2002-365874 12/2002
JP 2003-207971 7/2003
JP 2005-189794 7/2005

OTHER PUBLICATIONS

Japanese Office Action mailed on Oct. 28, 2008 directed at counterpart application JP-2006-067409; 3 pages.
Japanese Office Action mailed Mar. 31, 2009 directed to corresponding Japanese Application No. 2006-67409; (9 pages).

* cited by examiner

*Primary Examiner*—Hoang Ngo
(74) *Attorney, Agent, or Firm*—Morrison & Foerster LLP

(57) ABSTRACT

One of aspects of the present invention is to provide an image forming apparatus includes an intermediate transfer member rotating at a first circumferential speed, and an image carrier capable of having a plurality of toner images formed thereon in turn, each of the toner images having a color different from one another, for transferring the toner images onto the intermediate transfer member, the image carrier rotating at a second circumferential speed. At least one of the first and second circumferential speeds are adjustable in accordance with a driving mode selected from a group consisting of a monochrome mode and a color mode. Also, a first difference between the first and second circumferential speeds in the monochrome mode is greater than a second difference between the first and second circumferential speeds in the color mode.

20 Claims, 5 Drawing Sheets

IMAGE FORMING APPARATUS

CROSS-REFERENCE TO RELATED APPLICATION

The present application is based upon a Japanese Patent Application No. 2006-067409 filed on Mar. 13, 2006, all of which disclosure is incorporated by reference into the present application.

BACKGROUND OF THE INVENTION

1) Technical Field of the Invention

The present invention relates to a complex type of an image forming apparatus performing various functions as a printer, a copier, and a facsimile machine, and in particular, relates to the image forming apparatus capable of switching a color mode for reproducing a color image and a monochrome mode for forming a monochrome image.

2) Description of Related Arts

In general, a color image forming apparatus has the color mode for forming the color image and the monochrome mode for reproducing the monochrome (black and white) image, which can be switched. Also, the color image forming apparatus is well known to have two types of driving engines such as a four-cycle engine and a tandem engine, for reproducing the color image.

The image forming apparatus with the four-cycle engine includes a rotatable developing rack for receiving four developing devices each containing respective one of color toner of yellow, magenta, cyan, and black.

In a color mode operation of the image forming apparatus with the four-cycle engine, by rotation of the developing rack, each of the four developing devices received therein is arranged to oppose to an image carrier (or photoreceptor) in sequence. The image carrier is developed or receives the image thereon with the first toner supplied from the developing device firstly opposing to the image carrier. Then, the toner image on the image carrier is primarily transferred onto an intermediate transfer member (or an intermediate transfer belt). Similarly, three of other color toners, in turn, are primarily transferred onto the intermediate transfer member so that four color toner images are superimposed thereon. Then, the superimposed color images are secondarily transferred from the intermediate transfer member onto a paper.

In a monochrome mode operation of the image forming apparatus with the four-cycle engine, the developing rack rotates to arrange solely the developing device containing the black toner to oppose the image carrier, and then only the black toner image is primarily transferred thereon, which in turn is secondarily transferred onto the paper.

In the meanwhile, the image forming apparatus with the tandem engine includes four imaging units, each of which are arranged in straight along the intermediate transfer member, including the image carrier and the developing device.

In the color mode operation of the image forming apparatus with the tandem engine, similar to the four-cycle engine, the imaging units develop the toner images of yellow, magenta, cyan, and black, respectively, which are primarily transferred onto the intermediate transfer member in sequence for overlapping those toner images, and then secondarily transferred therefrom onto the paper at a time.

In the monochrome mode operation of the image forming apparatus with the tandem engine, only the black toner image is developed, primarily transferred, and secondarily transferred as described above.

The conventional color image forming apparatus has a couple of drawbacks, for example, each color image is not precisely registered to the other color images (which is referred to as "out-of-color-registration"). Also, a cleaning blade of the image carrier, which removes the toner remained thereon even after primarily transferring the toner image, may have a short lifetime by readily wearing away during limited operation. Therefore, a color image forming apparatus has been demanded, which avoids the out-of-color-registration and causes the cleaning blade to be less worn (abraded) away.

With regard to the former problem, if the image carrier has a circumferential speed (tangential speed of an outer surface thereof) set to be the same as that of the intermediate transfer member, the actual circumferential speed of the image carrier is slightly deviated from one of the intermediate transfer member so that each of the toner images is misaligned onto the intermediate transfer member, thereby causing the out-of-color-registration.

As suggested in a Japanese patent application, e.g., JP 2002-365874, A, which is referred to as Reference 1, in order to prevent the out-of-color-registration, the circumferential speed of the image carrier is usually set to be slightly offset from that of the intermediate transfer member. This effectively works to eliminate the out-of-color-registration. In the image forming apparatus of Reference 1, a difference of the circumferential speeds between the image carrier and the intermediate transfer member is provided in the color mode, for addressing the out-of-color-registration. Meanwhile, substantially no difference of the circumferential speeds between the image carrier and the intermediate transfer member is set in the monochrome mode.

As to the later drawback, i.e., the abrasion of the cleaning blade for the image carrier (image-carrier cleaning blade), a cohesive mass (agglomeration) is often built up on the intermediate transfer member and shifted therefrom onto the image carrier. The cohesive mass passing through a gap between the cleaning blade and the intermediate transfer member causes the abrasion of the edge of the cleaning blade, and may chip off a portion of the edge of the cleaning blade. The chipped portion of the edge causes the redundant toner on the image carrier that should have been removed off by the cleaning blade, to remain on the image carrier so that the toner image has an undesired line, which requires the cleaning blade to be replaced with a new one.

The aforementioned cohesive mass is believed to be generated by the toner or an external additive of the toner passing through a gap between the intermediate transfer member and the cleaning blade, and/or frictioning with a secondary transfer roller. Also, in the image forming apparatus with the four-cycle engine, since the cleaning blade for the intermediate transfer member (intermediate-transfer cleaning blade) contacts on and off the intermediate transfer member, the cohesive mass may be generated due to such on-and-off operation of the intermediate-transfer cleaning blade. More particularly, the toner accumulated adjacent the edge of the intermediate-transfer cleaning blade may remain on the intermediate transfer member after the cleaning blade is lifted off the intermediate transfer member, and/or the toner mass on the edge of the cleaning blade may drop onto the intermediate transfer member by the shaking (vibration) of the cleaning blade when being lifted off the intermediate transfer member, thereby generating the cohesive mass.

In the meanwhile, the abrasion of the image-carrier cleaning blade is likely accelerated when the developing device is not operated (i.e., no toner is supplied onto the image carrier). Thus, when the developing device is operated with the toner supplied onto the image carrier, the toner or the external additive of the toner on the image carrier is accumulated adjacent to the cleaning blade edge of the image carrier to define a stable layer extending along the cleaning blade edge, which blocks the cohesive mass from passing through the gap in between. However, when the image carrier continues to rotate without being supplied with toner from the developing device (i.e., no operation of the developing device), the stable layer shrinks and disappears due to no supply of the toner or the external additive of the toner. Then, the cohesive mass shifted from the intermediate transfer member likely passes through the gap between the image carrier and the image-carrier cleaning blade, without being blocked by the stable layer. Therefore, it is desirable to continuously operate the developing device in order to prevent the abrasion of the image-carrier cleaning blade.

On the contrary, the continuous operation of the developing device should be avoided since it may deteriorate the toner contained in the developing device. In general, the toner in the developing device is exposed to mechanical and electrical stress in a supply and/or restriction step and may be deteriorated for a long-term operation of the developing device. The toner deterioration causes various problems appeared on the reproduced image such as a fogged toner, a spilled toner, a reduced density of image, and an uneven density of image. Therefore, in order to avoid those problems, it is preferable that the developing device is operated only when forming the image and suspended during the time of no image being reproduced.

The time of no image being reproduced includes, for example, the times while the intermediate transfer member is being cleaned, while the image carrier is being charged and rotated for stabilizing a charging potential before forming the toner image, while the charge on the image carrier is being removed (neutralized) with charging and exposing light after forming the image, and while the developing rack in the four-cycle engine is being rotated.

As such, appropriate steps have to be taken for effectively preventing the abrasion of the image-carrier cleaning blade, especially in case where the image carrier is rotated but the developing device is not operated. This is important especially in the monochrome mode because in the four-cycle engine and the tandem engine of the image forming apparatus, the image-carrier cleaning blade is more likely abraded away in the monochrome mode rather than the color mode, as will be indicated below.

Thus, when the image forming apparatus with the four-cycle engines is used in the monochrome mode, the rotation of the intermediate transfer member that is required for forming the monochrome image is less than (i.e., one-fourth of) the total rotation thereof in number. In other words, the intermediate transfer member and the image carrier rotate while the developing device is not operated (i.e., while no toner is supplied onto the image carrier) in the monochrome mode. To the contrary, in the color mode, the intermediate transfer member and the image carrier rotate with the toner supplied onto the image carrier. Therefore, the image-carrier cleaning blade in the monochrome mode is more likely worn away than in the color mode.

Similarly, as the image forming apparatus with the tandem engine is used in the monochrome mode, since three of imaging units except black one are not driven when forming the black image, the image-carrier cleaning blade of those imaging units are likely bladed away due to lack of the stable layer on the cleaning blade edge.

SUMMARY OF THE INVENTION

In order to address the drawback of the abrasion of the cleaning blade for the image carrier, the present inventors have found it effective to prevent the cohesive mass generated on the intermediate transfer member from being shifted onto the image carrier. More importantly, the inventors have revealed that the cohesive mass is less shifted from the intermediate transfer member onto the image carrier, as there is greater difference of the circumferential speeds between the image carrier and the intermediate transfer member.

As discussed above, Reference 1 teaches that the circumferential speed of the image carrier is usually set to be slightly offset from that of the intermediate transfer member so as to prevent the out-of-color-registration. However, the present inventors have confirmed that the difference of the circumferential speeds for preventing the out-of-color-registration, which is disclosed in Reference 1, is too small to reduce the abrasion of the cleaning blade. Rather, in the image forming apparatus of Reference 1 that is designed to have substantially no difference of the circumferential speeds especially in the monochrome mode, the abrasion of the image-carrier cleaning blade is inevitable and may be accelerated.

Therefore, one of the purposes of the present invention is to provide an image forming apparatus which prevents the out-of-color-registration on the reproduced image and also reduces the abrasion of the image-carrier cleaning blade.

According to one of the aspects of the present invention, an image forming apparatus includes an intermediate transfer member rotating at a first circumferential speed, and an image carrier capable of having a plurality of toner images formed thereon in turn, each of the toner images having a color different from one another, for transferring the toner images onto the intermediate transfer member, the image carrier rotating at a second circumferential speed. At least one of the first and second circumferential speeds are adjustable in accordance with a driving mode selected from a group consisting of a monochrome mode and a color mode. Also, a first difference between the first and second circumferential speeds in the monochrome mode is greater than a second difference between the first and second circumferential speeds in the color mode.

According to another one of the aspects of the present invention, an image forming apparatus includes an intermediate transfer member rotating at a first circumferential speed; and a plurality of image carriers, each capable of having a toner image of a color different from one another, the color image carriers rotating at a second circumferential speed. The first circumferential speed is adjustable in accordance with a driving mode selected from a group consisting of a monochrome mode and a color mode. Also, a first difference between the first and second circumferential speeds in the monochrome mode is greater than a second difference between the first and second circumferential speeds in the color mode.

Alternatively, an image forming apparatus includes an intermediate transfer member rotating at a first circumferential speed, a plurality of color image carriers, each capable of having a colored toner image of a color different from one another, the color image carriers rotating at a second circumferential speed, and a monochrome image carrier capable of having a monochrome toner image, the monochrome image carrier rotating at a third circumferential speed. The second and third circumferential speeds are adjustable in accordance with a driving mode selected from a group consisting of a monochrome mode and a color mode. Also, a first difference between the first and third circumferential speeds in the monochrome mode is greater than a second difference between the first and second circumferential speeds in the color mode.

In those image forming apparatuses, the second circumferential speed is not less than the first circumferential speed, and the first circumferential speed in the color mode is greater than the first circumferential speed in the monochrome mode.

Alternatively, the second circumferential speed is not greater than the first circumferential speed, and the first circumferential speed in the color mode is less than the first circumferential speed in the monochrome mode.

Preferably, in the monochrome mode, the first circumferential speed is less than the second circumferential speed.

More preferably, in the color mode, a color-mode ratio of the first circumferential speed to the second circumferential speed falls within a range between 0.9934 through 1.0000, and in the monochrome mode, a monochrome-mode ratio of the first circumferential speed to the second circumferential speed is less than 0.9934.

Even more preferably, the color-mode ratio falls within a range between 0.9954 through 0.9983, and the monochrome-mode ratio falls within a range between 0.9500 through 0.9934.

The second circumferential speed is constant while the first circumferential speed is adjustable in accordance with the driving mode.

Alternatively, the first circumferential speed is constant while the second circumferential speed is adjustable in accordance with the driving mode.

Further scope of applicability of the present invention will become apparent from the detailed description given hereinafter and accompanying drawings which are given by way of illustration only, and thus are not limitative of the present invention. Also, it should be understood that various changes and modifications within the sprit and scope of the invention will become apparent to those skilled in the art from this detailed description.

DETAILED DESCRIPTION OF THE PREFERRED EMBODIMENTS

Referring to the attached drawings, the details of embodiment according to the present invention will be described hereinafter. In those descriptions, although the terminology indicating the directions (for example, "upper", "lower", "right", and" "left") is conveniently used just for clarity, it should not be interpreted that those terminology limit the scope of the present invention.

First Embodiment

Figure 1:
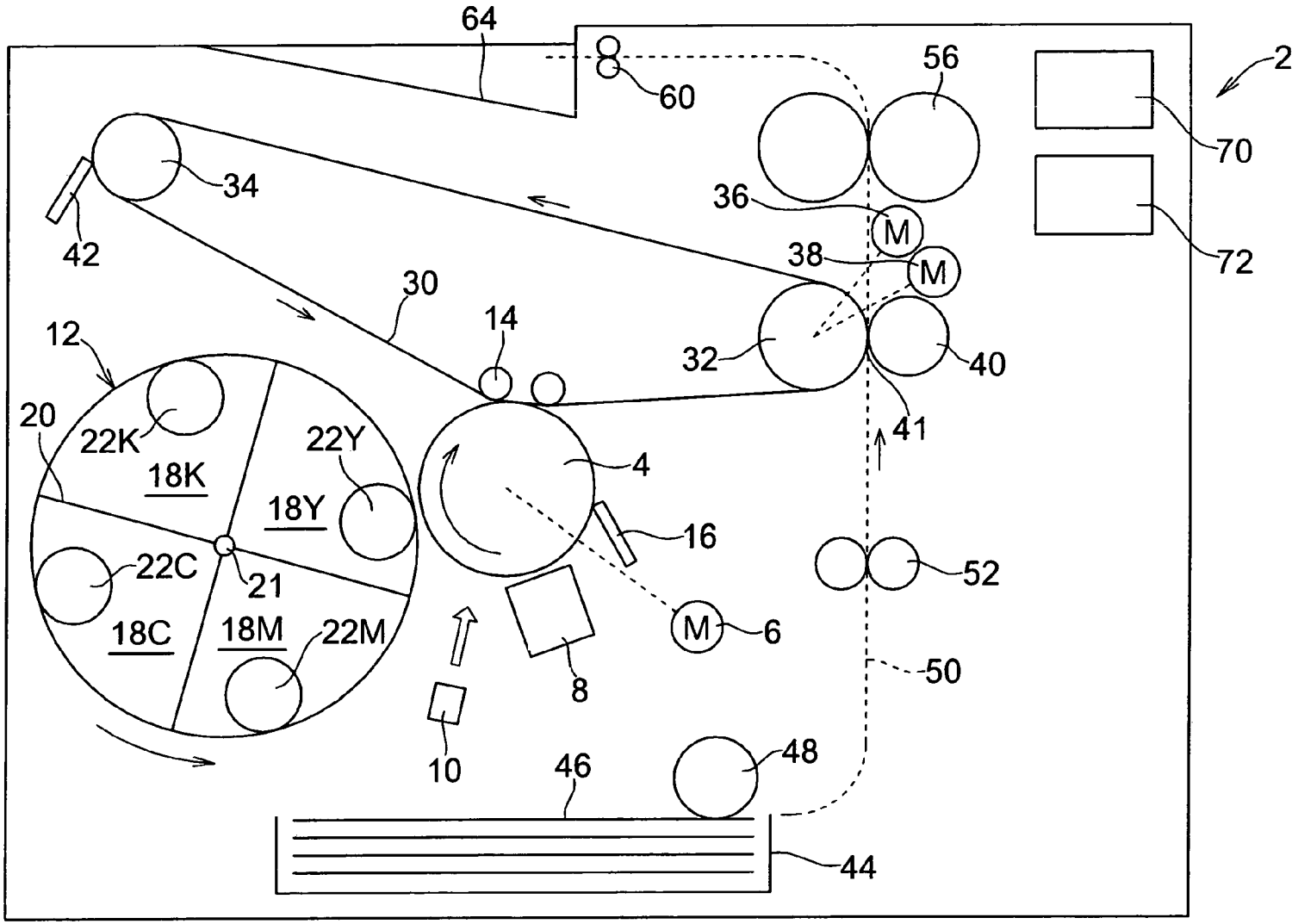
FIG. 1 is a schematic view of an image forming apparatus with a four-cycle engine according to the first embodiment of the present invention.

FIG. 1 is a schematic view of an image forming apparatus 2 with a four-cycle engine according to the first embodiment of the present invention. The image forming apparatus 2 includes a photoreceptor 4 as an image carrier appeared in the middle thereof. The photoreceptor 4 is driven by a driving motor 6 to rotate in a clockwise direction as illustrated by the arrow in FIG. 1 at a predetermined circumferential speed of $V_A$.

Also, the image forming apparatus 2 includes, in general, several components provided around the photoreceptor 4 in a sequence of the clockwise direction, i.e., an electron charger 8, an exposing device 10, a developing device 12, a primary transfer roller 14, and a cleaning blade 16 for the photoreceptor (photoreceptor cleaning blade) 4. The electron charger 8 may be a scorotron charger in FIG. 1, for evenly charging the surface of the photoreceptor 4. The exposing device 10 forms an electrostatic latent image of each of the colors on the photoreceptor 4. The developing device 12 sequentially supplies each of the color toners on the photoreceptor 4 to elicit the latent image. The primary transfer roller 14 transfers the toner image formed on the photoreceptor 4 to the intermediate transfer belt 30 as will be described below.

More specifically, the developing device 12 has a developing rack receiving four developing devices 18Y, 18M, 18C, 18K, arranged in an angularly spaced relationship by 90 degrees, each of which has yellow, magenta, cyan, and black toner, respectively. Also, it is capable of rotating around the axis 21 in the counter-clockwise direction in FIG. 1. The developing device 12 rotates by 90 degrees every time when the electrostatic latent image of each color is formed on the photoreceptor 4 so that each of developing rollers 22Y, 22M, 22C, 22K of the developing devices 18Y, 18M, 18C, 18K is shifted to the developing position where it comes close to or actually contacts with the photoreceptor 4. Each of the developing rollers 22Y, 22M, 22C, 22K is properly applied with a predetermined voltage by a biasing power supply (not shown).

Each of the developing devices 18Y, 18M, 18C, 18K contains a one-component toner. The toner includes a binding agent and a coloring agent, with an external additive added thereto. Further, each of the developing devices 18Y, 18M, 18C, 18K includes a supply roller for supplying the toner onto the respective one of the developing rollers 22Y, 22M, 22C, 22K, and a regulation blade held by the developing roller for regulating thickness of the toner layer and for charging the toner layer with given electron charge.

The photoreceptor cleaning blade 16 is designed such that the tip thereof contacts on the surface of the photoreceptor 4 in order to scrape off the toner remained thereon after primarily transferring the image onto the intermediate transfer belt 30.

The intermediate transfer belt (intermediate transfer member) 30, which is provided over the photoreceptor 4 and supported by a pair of rollers 32, 34, is driven to rotate in a counter-clockwise direction in FIG. 1. Also, driving motors 36, 38 are connected to one of the rollers 32 for driving it, and the other one of the rollers 34 is also driven for rotation in accordance with the rotation of the roller 32.

Thus, the roller 32 is connected to the color-mode driving motor 36 for driving the roller 32 only when forming the image in the color mode, and to the monochrome-mode driving motor 38 for driving the roller 32 only where the monochrome mode is selected.

Also, the image forming apparatus 2 includes a switching device 70 allowing a user to choose either one of the color mode where four-colored toner images are superimposed on the intermediate transfer belt 30 for forming the multi-color image, and the monochrome mode where only the black toner image is transferred on the intermediate transfer belt 30 for forming the monochrome image.

Further, the image forming apparatus 2 includes a controller 72 for driving the color-mode driving motor 36, when the color mode is selected, to rotate the intermediate transfer belt 30 at a first circumferential speed of $V_{BC}$, and for driving the monochrome-mode driving motor 38, when the monochrome mode is selected, to rotate the intermediate transfer belt 30 at a second circumferential speed of $V_{BK}$. Thus, the controller 72 drives either one of the color-mode driving motor 36 and the monochrome-mode driving motor 38 in accordance with the mode selected by the switching device 70, thereby switching the circumferential speed $V_{BC}$ or $V_{BK}$ of the intermediate transfer belt 30 through use of either one of the color-mode driving motor 36 and the monochrome-mode driving motor 38. Also, the controller 72 controls the photoreceptor 4 to rotate at a circumferential speed of $V_A$.

According to the present embodiment of the invention, the difference of the circumferential speeds in the monochrome mode between the photoreceptor 4 and the intermediate transfer belt 30 ($\Delta d_{BK}=|V_A-V_{BK}|$) is set to be greater than that in the color mode ($\Delta d_{BC}=|V_A-V_{BC}|$), i.e., $\Delta d_{BK}>\Delta d_{BC}$.

If the first circumferential speed $V_{BC}$ in the color mode is set greater than the second circumferential speed of $V_{BK}$ in the monochrome mode (i.e., $V_{BC}>V_{BK}$), the controller 72 controls the circumferential speed $V_A$ of the photoreceptor 4 to be equal or greater than the first and second circumferential speeds of $V_{BC}$, $V_{BK}$ (i.e., $V_A>V_{BC}$ and $V_A>V_{BK}$). For instance, the color-mode ratio ($V_{BC}/V_A$) of the first circumferential speed $V_{BC}$ of the intermediate transfer belt 30 to the circumferential speed $V_A$ of the photoreceptor 4 may be set in a range from 0.9934 to 1.0000, and preferably in a range from 0.9954 to 0.9983. Also, the monochrome-mode ratio ($V_{BK}/V_A$) of the second circumferential speed $V_{BK}$ of the intermediate transfer belt 30 to the circumferential speed $V_A$ of the photoreceptor 4 may be set in a range from 0.9500 to 0.9934.

Alternatively, as far as the difference of the circumferential speeds in the monochrome mode ($\Delta d_{BK}=|V_A-V_{BK}|$) is set to be greater than that in the color mode ($\Delta d_{BC}=|V_A-V_{BC}|$) as stated above, the circumferential speed $V_A$ of the photoreceptor 4 may be controlled to be equal or less than the first and second circumferential speeds of $V_{BC}$, $V_{BK}$ (i.e., $V_A<V_{BC}$ and $V_A<V_{BK}$), while the first circumferential speed $V_{BC}$ in the color mode is set less than the second circumferential speed of $V_{BK}$ in the monochrome mode (i.e., $V_{BC}<V_{BK}$).

Also, although not limited to the use of the different driving motors 36, 38, any other ways for achieving either one of the circumferential speeds $V_{BC}$, $V_{BK}$ of the intermediate transfer belt 30 could be conceived by a person skilled in the relevant art. For example, a single driving motor with a pulse encoder may be used for driving the intermediate transfer belt 30, in which a signal for the rotation speed is detected by the pulse encoder and transmitted to the controller 72. Then, the controller 72 uses the signal of the rotation speed to control the intermediate transfer belt 30 for rotation at the first circumferential speed $V_{BC}$ in the color mode and at the second circumferential speed $V_{BK}$ in the monochrome mode (i.e., feed-back control). In another example, a single pulse motor may be used as the driving motor for controlling the first and second circumferential speeds $V_{BC}$, $V_{BK}$ of the intermediate transfer belt 30.

As above, although the circumferential speed $V_A$ of the photoreceptor 4 is described to be constant in both of the color and monochrome modes while the circumferential speeds $V_{BC}$, $V_{BK}$ of the intermediate transfer belt 30 are switched in accordance with the mode selection, the circumferential speed $V_A$ of the photoreceptor 4 may be varied or switched while the intermediate transfer belt 30 has a fixed circumferential speed. Alternatively, the circumferential speeds of both of the photoreceptor 4 and the intermediate transfer belt 30 may be changed or switched based upon the mode selection.

The circumferential length of the intermediate transfer belt 30 is set to be integral multiple of the circumferential length of the photoreceptor 4 and greater than the maximum length of the image. The intermediate transfer belt 30 is provided with a home position as a reference to facilitate initiation of various steps for forming the image, in which a detection opening is arranged at the side extending along the transferring direction, allowing the detection of the home position.

The primary transfer roller 14 is provided within a loop of the intermediate transfer belt 30, opposing to the photoreceptor 4 for sandwiching the intermediate transfer belt 30 together with the photoreceptor 4. Thus, the primary transfer roller 14 continuously contacts with the intermediate transfer belt 30 and biases it towards photoreceptor 4.

Also, a secondary transfer roller 40 and a cleaning blade 42 for the intermediate transfer belt 30 (belt cleaning blade 42) are provided outside the loop of the intermediate transfer belt 30. The secondary transfer roller 40 is selectively driven in either one of conditions where it contacts with the intermediate transfer belt 30 and biases it towards the roller 32 and where it is spaced from the intermediate transfer belt 30. A secondary transfer region 41 is defined between the secondary transfer roller 40 and the intermediate transfer belt 30 for secondarily transferring the image onto a paper, as will be described later.

The belt cleaning blade 42 is also selectively driven in either one of conditions where the tip thereof contacts with the intermediate transfer belt 30 at a portion supported by the roller 34 and where the tip thereof is spaced from the intermediate transfer belt 30. The tip of the belt cleaning blade 42, while in contact with the intermediate transfer belt 30, scrapes off the toner remained on the surface thereof after secondarily transferring the image on the paper.

The image forming apparatus 2 further includes a paper feed cassette 44 removably arranged in the lower portion thereof. The paper feed cassette 44 contains a pile of papers (recording media) 46, each of which is fed from the top one by one into a paper passage 50, upon rotation of a feed roller opposing to the leading end of the paper.

The paper is fed from the paper feed cassette 44, through a nipping region between a pair of timing rollers 52, the secondary transfer region 41, and another nipping region between a pair of ejecting rollers 60, to a catch tray 64 provided in the upper portion of the image forming apparatus 2.

Figure 2:
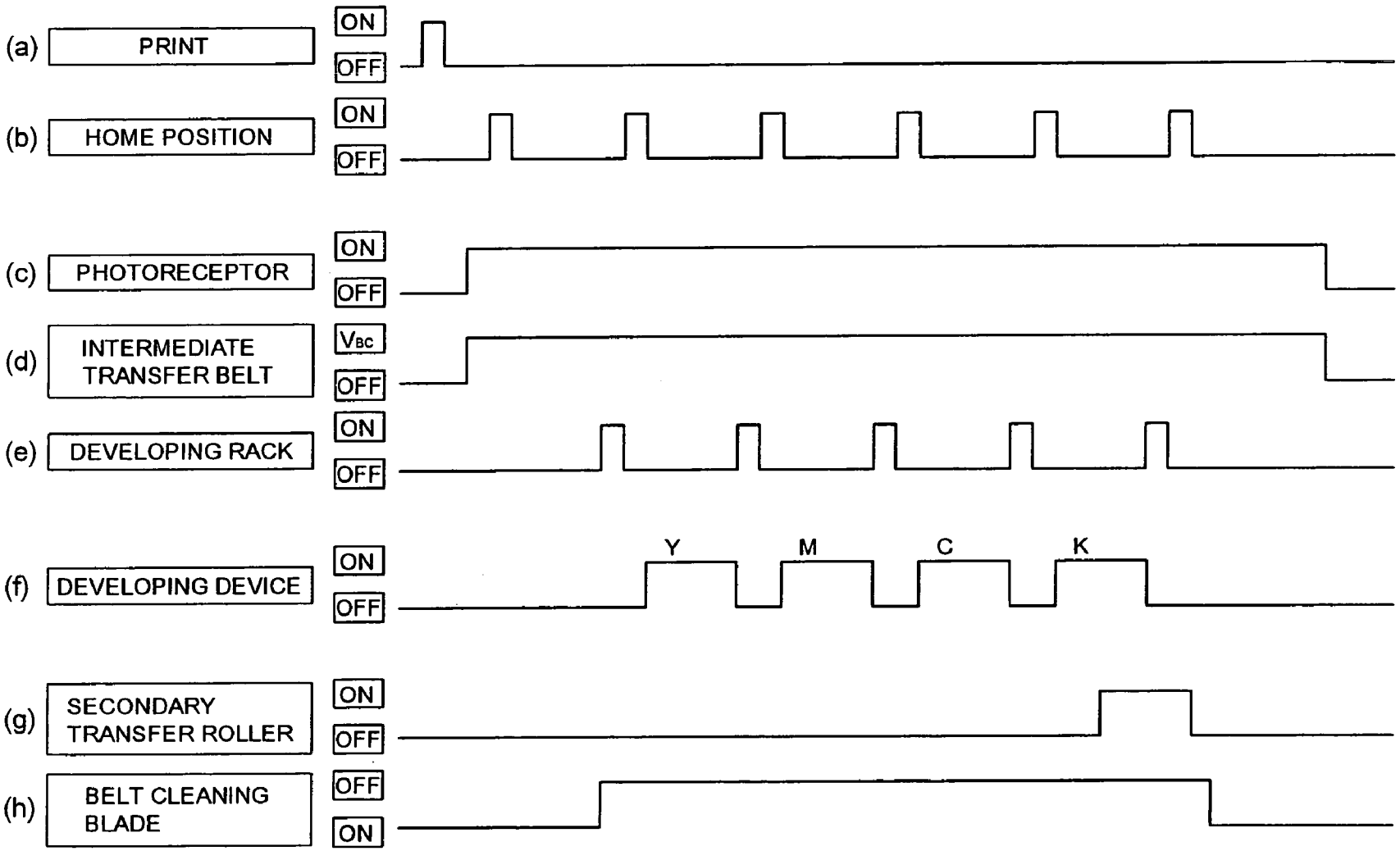
FIG. 2 is a time chart of various signals in a color mode of the image forming apparatus of FIG. 1.
Figure 3:
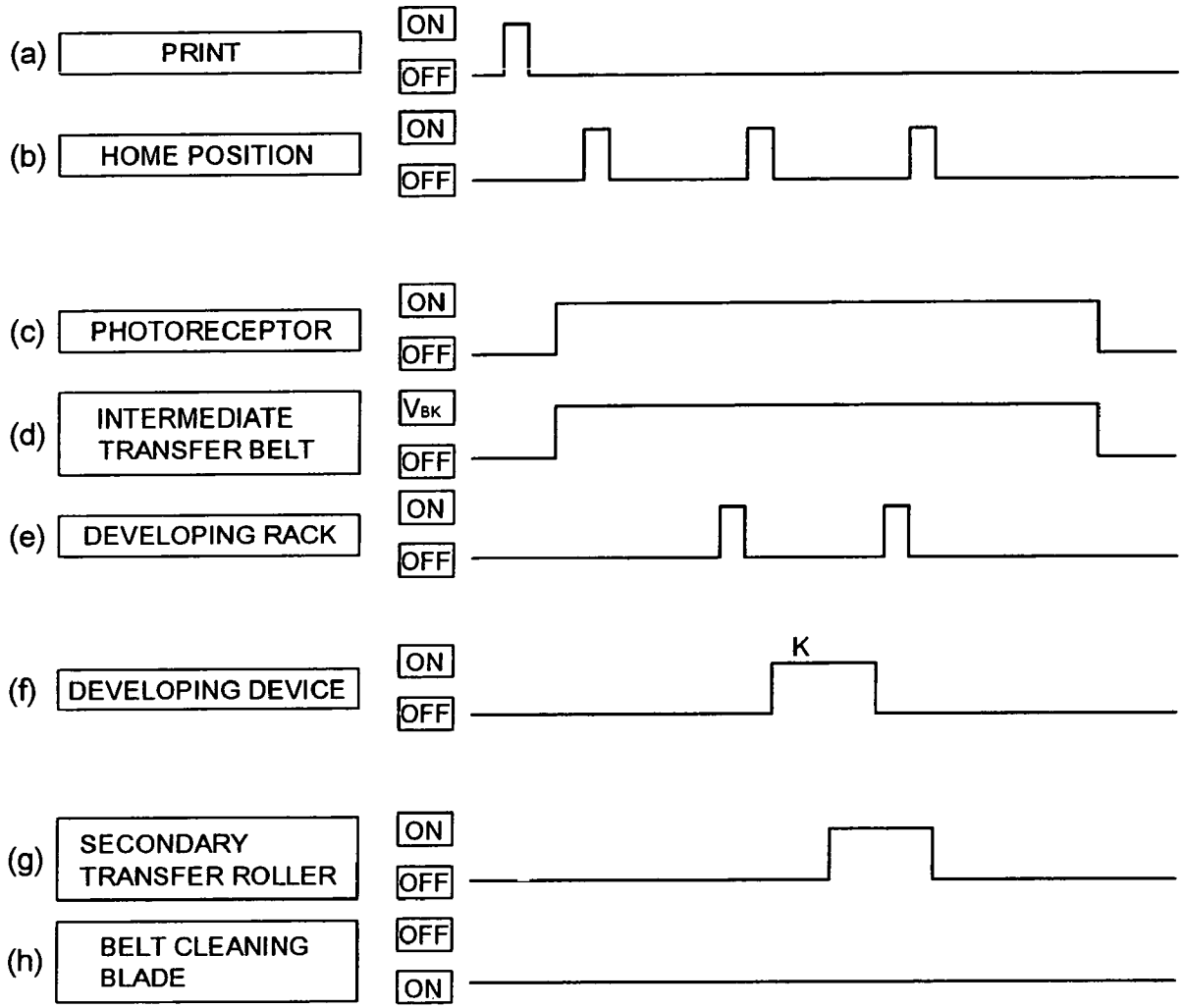
FIG. 3 is a time chart of various signals in a monochrome mode of the image forming apparatus of FIG. 1.

Next, referring to the flowcharts of FIGS. 2 and 3, the operation of the image forming apparatus 2 will be described hereinafter.

As described above, the image forming apparatus 2 can selectively be used in either one of the color mode for forming the color image and a monochrome mode for reproducing the monochrome image. Thus, the mode can be switched from the color mode to the monochrome mode and vice versa, by the switching device 70 receiving a signal transmitted from an external terminal or from a console or control panel (both not shown) provided on the image forming apparatus 2.

Firstly, the operation for forming the image in the color mode will be described herein. As illustrated in FIG. 2A, upon receiving a print signal from the external terminal or the console, the controller 72 initiates the photoreceptor 4 and the intermediate transfer belt 30 at a given time for rotation, as shown in FIGS. 2C and 2D.

After the intermediate transfer belt 30 starts rotating, when a transmissive optical sensor, provided at a given place close to the intermediate transfer belt 30, detects the detection opening in the intermediate transfer belt 30, it outputs home-position signals to the controller 72 as illustrated in FIG. 2B. Upon receiving the first home-position signal from the optical sensor, the controller 72 drives the electron charger 8 to charge the surface of the photoreceptor 4 at a given potential, for example, in a range between −450 and −500 volts, for stabilizing the potential across the surface of the photoreceptor 4. Also, the controller 72 drives the developing rack 20 for rotation, as illustrated in FIG. 2E, so that the developing device 18Y containing the yellow toner opposes to the photoreceptor 4. Further, as shown in FIG. 2H, the belt cleaning blade 42 is driven to be spaced away from the intermediate transfer belt 30 while primarily transferring the toner image onto the intermediate transfer belt 30.

Upon receiving the second home-position signal shown in FIG. 2B, the controller 72 controls the exposing device 10 to form the electrostatic latent image of the yellow on the photoreceptor 4 and drives the developing device 18Y containing the yellow toner to elicit the latent image with the yellow toner, as depicted in FIG. 2F. Also, the controller 72 drives the primary transfer roller 14 to be applied with a positive potential in a range between 800 and 1000 volts.

Further, by rotation of the photoreceptor 4, the yellow toner image on the photoreceptor 4 is brought to the intermediate transfer belt 30 intervened between the primary transfer roller 14 and the photoreceptor 4, and then primarily transferred from the photoreceptor 4 onto the intermediate transfer belt 30.

After the primary transfer, the toner remained on the photoreceptor 4 is scraped off by the edge of the cleaning blade 16 for thoroughly cleaning the surface of the photoreceptor 4.

Then, the developing device 18Y containing the yellow toner is suspended at the time as shown in FIG. 2F, upon completion of the developing and the primary transfer of the yellow image. Again, the surface of the photoreceptor 4 is charged, and the developing rack 20 is driven for rotation, as illustrated in FIG. 2E, so that the developing device 18M containing the magenta toner opposes to the photoreceptor 4.

Upon receiving the third home-position signal shown in FIG. 2B, the controller 72 controls the exposing device 10 to form the magenta latent image on the photoreceptor 4 and drives the developing device 18Y containing the magenta toner to elicit the latent image with the magenta toner, as depicted in FIG. 2F.

The primarily transfer of the magenta image and the cleaning of the surface of the photoreceptor 4 are performed similarly to those for the yellow image formation. Then, the primarily transfer of the magenta image causes the magenta toner image to be superimposed onto the yellow toner image having been carried on the intermediate transfer belt 30.

In addition, the cyan and black toner images are primarily transferred onto the intermediate transfer belt 30 so that the toner images of four colors are superimposed thereon. At a given time during operation of the developing device 18K containing the black toner, the controller 72 applies the secondary transfer roller 40 with a potential of polarity opposite to that of the toner as illustrated in FIG. 2G. After completion of the primary transfer of the toner images of four colors, the developing rack 20 rotates for arranging each of the developing devices 18Y, 18M, 18C, 18K to a position desirable for replacement.

The superimposed toner images of four colors on the intermediate transfer belt 30 are brought to the secondary transfer region 41, while the paper 46 received in the feed cassette 44 is fed also to the secondary transfer region 41. Then, the superimposed toner images are secondarily transferred onto the paper which is delivered downstream through the passage 50 to a fuser roller 56. Also, the fuser roller 56 fuses or fixes the superimposed toner images on the paper 46 which is in turn ejected to the catch tray 64.

Application of the potential to the secondary transfer roller 40 is ceased at a given time as shown in FIG. 2G, while the tip of the belt cleaning blade 42 contacts again on the intermediate transfer belt 30 at a given time as shown in FIG. 2H. Also, upon receiving the sixth home-position signal as illustrated in FIG. 2B, the controller 72 suspends the photoreceptor 4 and the intermediate transfer belt 30 as depicted in FIGS. 2C and 2D.

Rotation of the intermediate transfer belt 30 with the tip of the belt cleaning blade 42 contacted thereon scrapes off the toner remained on the intermediate transfer belt 30 for cleaning thereof. Since the intermediate transfer belt 30 rotates by at least one entire loop after the tip of the belt cleaning blade 42 contacts onto the intermediate transfer belt 30, the whole surface of the intermediate transfer belt 30 is fully cleaned up.

Positive and negative potentials may repeatedly be applied to the secondary transfer roller 40 for ejecting the remained toner thereon to the intermediate transfer belt 30, thereby cleaning the secondary transfer roller 40. In this case, the intermediate transfer belt 30 is to be kept rotating until the ejected toner is fully removed away therefrom.

In the meanwhile, the photoreceptor 4 is charged by the electron charger 8 and exposed by the exposing device 10 so that the electrostatic latent image remained on the photoreceptor 4 is completely erased, i.e., electrically neutralizing the photoreceptor 4.

With the color mode selected, the intermediate transfer belt 30 is driven by the color-mode driving motor 36 to rotate at the circumferential speed $V_{BC}$. As described above, the difference of the circumferential speeds between the photoreceptor 4 and the intermediate transfer belt 30 secures to prevent the out-of-color-registration on the reproduced image.

Next, the operation for forming the image in the monochrome mode will be described herein. As illustrated in FIG. 3A, upon receiving the print signal from the external terminal or the console, the controller 72 initiates the photoreceptor 4 and the intermediate transfer belt 30 for rotation.

Upon receiving the first home-position signal, the controller 72 drives the electron charger 8 to charge the surface of the photoreceptor 4 at a given potential, for example, in a range between −450 and −500 volts, for stabilizing the potential across the surface of the photoreceptor 4. Also, the controller 72 drives the developing rack 20 for rotation, as illustrated in FIG. 3E, so that the developing device 18K containing the black toner opposes to the photoreceptor 4. Unlike the case of the color mode, the belt cleaning blade 42 is kept in contact with the intermediate transfer belt 30 as shown in FIG. 3H.

Upon receipt of the second home-position signal shown in FIG. 3B, the controller 72 controls the exposing device 10 to expose the photoreceptor 4 with the electrostatic latent image of black and drives the developing device 18K containing the black toner to elicit the latent image with the black toner, as illustrated in FIG. 3F. Also, the controller 72 drives the primary transfer roller 14 to be applied with a positive potential in a range between 800 and 1000 volts.

Further, by rotation of the photoreceptor 4, the black toner image on the photoreceptor 4 is brought to the intermediate transfer belt 30 intervened between the primary transfer roller 14 and the photoreceptor 4, and then primarily transferred from the photoreceptor 4 onto the intermediate transfer belt 30.

After the primary transfer, the toner remained on the photoreceptor 4 is scraped off by the edge of the photoreceptor cleaning blade 16 for fully cleaning the surface of the photoreceptor 4.

At a given time during operation of the developing device 18K containing the black toner, the secondary transfer roller 40 is applied with a potential of polarity opposite to that of the toner as illustrated in FIG. 3G.

The developing device 18K containing the black toner is suspended at the time as shown in FIG. 3F, upon completion of the developing and the primary transfer of the black image. Then, the developing rack 20 rotates for arranging each of the developing devices 18Y, 18M, 18C, 18K to a position desirable for replacement.

The black toner image primarily transferred on the intermediate transfer belt 30 is brought to the secondary transfer region 41, while the paper 46 received in the feed cassette 44 is fed also to the secondary transfer region 41. Then, the black toner image is secondarily transferred onto the paper which is delivered downstream through the passage 50 to the fuser roller 56. Also, the fuser roller 56 fuses or fixes the black toner image on the paper 46 which is in turn ejected to the catch tray 64.

Application of the potential to the secondary transfer roller 40 is ceased at a given time as shown in FIG. 3G. Also, upon receipt of the third home-position signal as illustrated in FIG. 3B, the controller 72 controls some post-transfer steps such as the cleaning step of the intermediate transfer belt 30 which are similar to those for the color mode. Then, the controller 72 suspends the photoreceptor 4 and the intermediate transfer belt 30 as depicted in FIGS. 3C and 3D.

With the monochrome mode selected, the intermediate transfer belt 30 is driven by the monochrome-mode driving motor 38 to rotate at the circumferential speed $V_{BK}$. As described above, even in the monochrome mode, there is the difference of the circumferential speeds between the photoreceptor 4 and the intermediate transfer belt 30, which is greater than that in the color mode. Thus, this difference of the circumferential speeds prevents the cohesive mass off the intermediate transfer belt 30 from shifting onto the photoreceptor 4. Therefore, the reduction of the cohesive mass on the photoreceptor 4 causes less abrasion of the photoreceptor cleaning blade 16.

When forming color and monochrome images sequentially, the controller 72 switches from one of the color-mode and monochrome-mode driving motors 36, 38 to the other one after the whole toner image(s) onto the intermediate transfer belt 30 is secondarily transferred onto the paper. Also, after switching the driving motor, the controller 72 await a predetermined time enough for the stable circumferential speed of the intermediate transfer belt 30 to initiate forming the other mode image.

Second Embodiment

Figure 4:
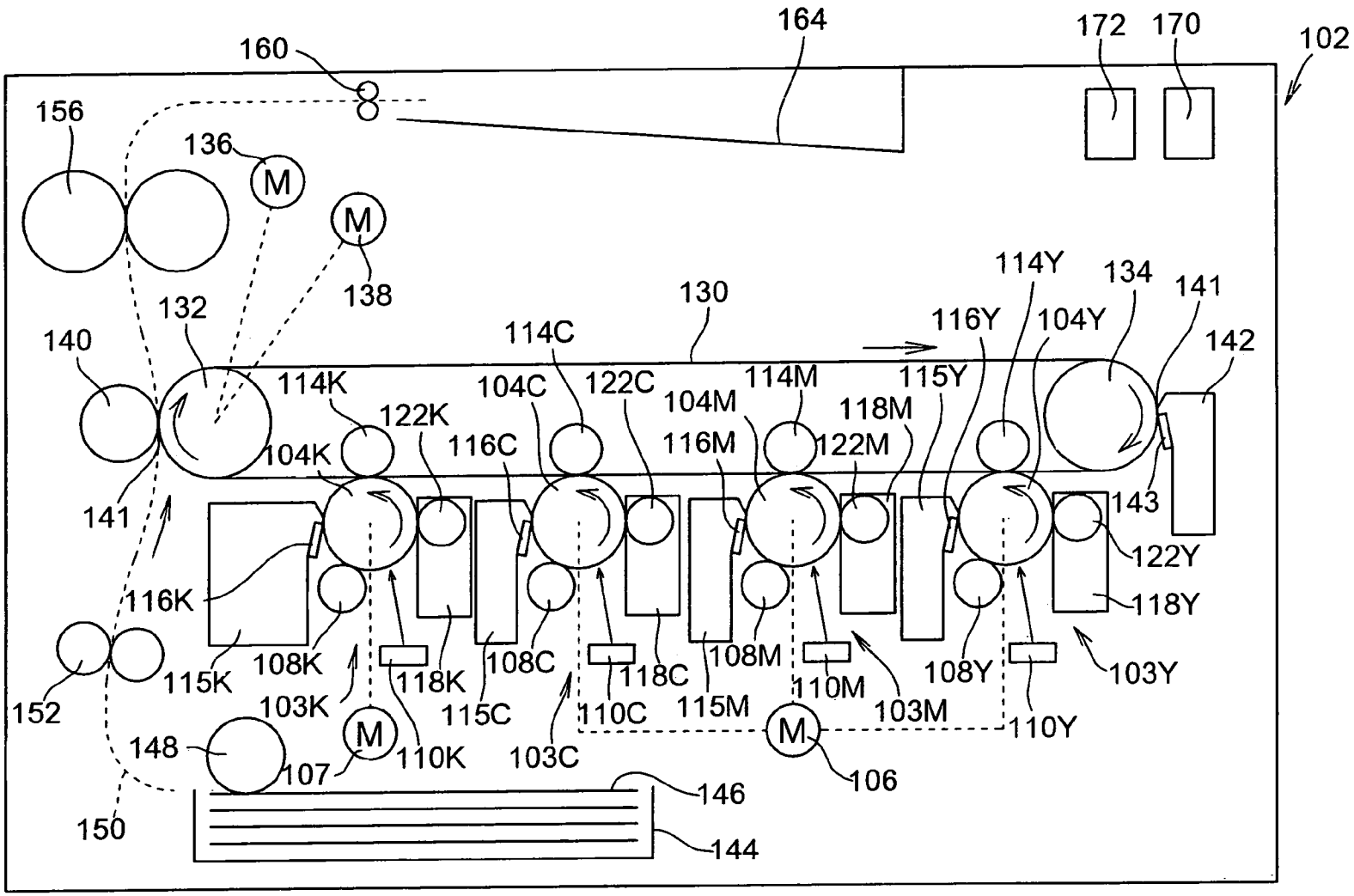
FIG. 4 is a schematic view of an image forming apparatus with a tandem engine according to the second embodiment of the present invention.

FIG. 4 is a schematic view of an image forming apparatus 102 with a tandem engine according to the second embodiment of the present invention. The image forming apparatus 102 includes an intermediate transfer belt 130 as the intermediate transfer member in the middle thereof.

The image forming apparatus 102 includes a switching device 170 for switching either one of the color mode where four-colored toner images are superimposed on the intermediate transfer belt 130 for forming the multi-color image, and the monochrome mode where only the black toner image is transferred on the intermediate transfer belt 130 for forming the monochrome image.

Also, the image forming apparatus 102 includes a controller 172 for driving the intermediate transfer belt 130 to rotate at a first circumferential speed in the color mode and at a second circumferential speed in the monochrome mode.

The intermediate transfer belt 130 is supported by outer surfaces of a pair of rollers 132, 134 and is designed to rotate in a clockwise direction in FIG. 4. One of the rollers 132 is driven for rotation by either one of the driving motors 136, 138, and the other one of rollers 134 is driven by the rotation of the roller 132.

Thus, the roller 132 is connected to the color-mode driving motor 136 for driving the roller 132 only when forming the image in the color mode, and to the monochrome-mode driving motor 138 for driving the roller 132 only where the monochrome mode is selected. Thus, the driving motor for the intermediate transfer belt 130 is selected from a group consisting of the color-mode driving motor 136 and the monochrome-mode driving motor 138 in accordance with the switching device 170, which switches the circumferential speed of the intermediate transfer belt 130.

Also, a secondary transfer roller 140 and a cleaning device 142 for the intermediate transfer belt 130 are provided outside the loop of the intermediate transfer belt 130. A secondary transfer region 141 is defined between the secondary transfer roller 140 and the intermediate transfer belt 130 for secondarily transferring the image onto a paper. The cleaning device 142 includes a cleaning blade 143, of which tip is provided in contact with the intermediate transfer belt 130 at a portion which is supported by the roller 134. The tip of the cleaning blade 142 scrapes off the toner remained on the surface thereof after secondarily transferring the image on the paper.

The image forming apparatus 102 further includes four imaging units 103Y, 103M, 103C, 103K corresponding to the colors of yellow (Y), magenta (M), cyan (C), and black (B), respectively, which are arranged beneath and along the intermediate transfer belt 130. The imaging units 103Y, 103M, 103C, 103K include photoreceptors 104Y, 104M, 104C, 104K as the image carrier, respectively. The photoreceptors 104Y, 104M, 104C, 104K are driven to rotate in a counterclockwise direction in FIG. 4. The controller 172 controls the circumferential speeds of the photoreceptors 104Y, 104M, 104C, 104K to be equal or greater than the first circumferential speed of the intermediate transfer belt 130. As illustrated in FIG. 4, the photoreceptors 104Y, 104M, 104C of the imaging units 103Y, 103M, 103C are connected to one of the driving motors 106, while the photoreceptor 104K of the imaging units 103K is connected to the other one of the driving motors 107. Alternatively, each of the photoreceptors 104Y, 104M, 104C, 104K is connected to the respective one of the driving motors.

Similar to the first embodiment, the difference of the circumferential speeds in the monochrome mode between each of the photoreceptors 104Y, 104M, 104C, 104K and the intermediate transfer belt 130 is set to be greater than that in the color mode. As far as so controlled, the circumferential speed of the intermediate transfer belt 130 may be set greater than those of the photoreceptors 104Y, 104M, 104C, 104K, while the circumferential speed of the intermediate transfer belt 130 in the color mode is greater than that in the monochrome mode.

Also, although not limited to the use of the different driving motors 136, 138, any other ways for selectively achieving either one of the circumferential speeds of the intermediate transfer belt 130 could be conceived by a person skilled in the relevant art. For example, a single driving motor with a pulse encoder may be used for driving the intermediate transfer belt 130, in which a signal for the rotation speed is detected by the pulse encoder and transmitted to the controller 172. Then, the controller 172 uses the signal of the rotation speed to control the intermediate transfer belt 130 for rotation at the first circumferential speed in the color mode and at the second circumferential speed in the monochrome mode (i.e., feedback control). In another example, a pulse motor may be used as the driving motor for controlling the first and second circumferential speeds of the intermediate transfer belt 130.

As above, although the circumferential speeds of the photoreceptors 104Y, 104M, 104C, 104K are described to be constant in both of the color and monochrome modes while the circumferential speeds of the intermediate transfer belt 130 are switched in accordance with the mode selection, the circumferential speeds of the photoreceptor 104Y, 104M, 104C, 104K may be switched based upon the mode selection. Alternatively, the circumferential speeds of both of the photoreceptors 104Y, 104M, 104C, 104K and the intermediate transfer belt 130 may be changed or switched based upon the mode selection.

Each of the imaging units 103Y, 103M, 103C, 103K further includes, around the photoreceptor 104Y, 104M, 104C, 104K, an electron charger 108Y, 108M, 108C, 108K, an exposing device 110Y, 110M, 110C, 110K, a developing device 112Y, 112M, 112C, 112K, a primary transfer roller 114Y, 114M, 114C, 114K, and a cleaning device 115Y, 115M, 115C, 115K for the photoreceptor, respectively. Each of the primary transfer rollers 114Y, 114M, 114C, 114K is arranged opposing to the photoreceptor 104Y, 104M, 104C, 104K with the intermediate transfer belt 130 intervened in between, for primarily transferring the toner image formed on the photoreceptor to the intermediate transfer belt, respectively.

Each of the developing devices 118Y, 118M, 118C, 118K contains a one-component toner. The toner includes a binding agent and a coloring agent with an external additive added thereto. Further, each of the developing devices 118Y, 118M, 118C, 118K has a developing roller 122Y, 122M, 122C, 122K, respectively, which is properly applied with a given potential by a biasing power supply (not shown).

Also, each of the cleaning device 115Y, 115M, 115C, 115K has a cleaning blade 116Y, 116M, 116C, 116K, of which edge is in contact with the photoreceptor 104Y, 104M, 104C, 104K and scrapes off the toner remained on the surface of the photoreceptor 104Y, 104M, 104C, 104K, respectively, after the primary transfer of the toner images.

The image forming apparatus 102 further includes a paper feed cassette 144 removably arranged in the lower portion thereof. The paper feed cassette 144 contains a pile of papers (recording media) 146, each of which on the top is fed one by one into a paper passage 150 upon rotation of a feed roller opposing to the leading end of the paper.

The paper is fed from the paper feed cassette 144, through a nipping region between a pair of timing rollers 152, the secondary transfer region 141, and another nipping region between a pair of ejecting rollers 160, to a catch tray 164 provided in the upper portion of the image forming apparatus 102.

Next, the operation of the image forming apparatus 102 will be described herein. As described above, the image forming apparatus 102 can selectively be used in either one of the color mode for forming the color image and a monochrome mode for reproducing the monochrome image. Thus, the mode can be switched from the color mode to the monochrome mode and vice versa, by the switching device 170 receiving a signal transmitted from an external terminal or from a console or control panel (both not shown) provided on the image forming apparatus 102.

Firstly, the operation for forming the image in the color mode will be described herein. Similar to the first embodiment, upon receiving a print signal from the external terminal or the console, the controller 72 initiates the photoreceptors 104Y, 104M, 104C, 104K of the imaging units 103Y, 103M, 103C, 103K and the intermediate transfer belt 130 for rotation.

After the intermediate transfer belt 130 starts rotating, the controller 172 drives the electron chargers 108Y, 108M, 108C, 108K to charge the surface of the photoreceptors 104Y, 104M, 104C, 104K, for stabilizing the potential across the surfaces of the photoreceptors 104Y, 104M, 104C, 104K. Also, the controller 172 drives the developing devices 118Y, 118M, 118C, 118K and applies the primary transfer rollers 114Y, 114M, 114C, 114K with a potential of polarity opposite to that of the toners.

The controller 172 controls the exposing devices 110Y, 110M, 110C, 110K of the imaging units 103Y, 103M, 103C, 103K to form the electrostatic latent images of each color on the photoreceptors 104Y, 104M, 104C, 104K, respectively, which are elicited with each of the color toners. By rotation of the photoreceptors 104Y, 104M, 104C, 104K, the toner images so formed thereon are brought to the intermediate transfer belt 130 intervened between the primary transfer roller 114Y, 114M, 114C, 114K, and then primarily transferred from the photoreceptors onto the intermediate transfer belt 130.

After the primary transfer, each of the toners remained on the photoreceptors is scraped off by the edge of the cleaning blade 116Y, 116M, 116C, 116K for thoroughly cleaning the surface of the photoreceptor 104Y, 104M, 104C, 104K, respectively. Then, the developing devices 118Y, 118M, 118C, 118K of the imaging units 103Y, 103M, 103C, 103K are suspended shortly after the primary transfer.

During operation of the developing devices 118Y, 118M, 118C, 118K, the secondary transfer rollers 140 is applied with a potential of polarity opposite to that of the toners.

The superimposed toner images of four colors on the intermediate transfer belt 130 are brought to the secondary transfer region 141, while the paper 146 received in the feed cassette 144 is fed also to the secondary transfer region 141. Then, the superimposed toner images are secondarily transferred onto the paper 146, which is delivered downstream through the passage 150 to a fuser roller 156. Also, the fuser roller 156 fuses or fixes the superimposed toner images on the paper 146 which is in turn ejected to the catch tray 164.

Again, similar to the first embodiment, after the post-transfer steps such as the cleaning step of the intermediate transfer belt 130 are performed, rotation of the photoreceptors 104Y, 104M, 104C, 104K and the intermediate transfer belt 130 are stopped.

With the color mode selected, as described above, the difference of the circumferential speeds between each of the photoreceptors 104Y, 104M, 104C, 104K and the intermediate transfer belt 130 secures to prevent the out-of-color-registration on the reproduced image.

Next, the operation for forming the image in the monochrome mode will be described herein. Upon receiving the print signal from the external terminal or the console, the controller 172 initiates the photoreceptors 104Y, 104M, 104C, 104K and the intermediate transfer belt 130 for rotation.

After the intermediate transfer belt 130 starts rotating, the controller 172 drives the electron charger 108K of the imaging unit 103K to charge the surface of the photoreceptor 104K for stabilizing the potential across the surfaces of the photoreceptor 104K. Also, the controller 172 drives the developing device 118K and applies the primary transfer roller 114K of the imaging unit 103K with a potential of polarity opposite to that of the black toner. Also, the controller 172 initiates the photoreceptor 104Y, 104M, 104C for rotation, but does not drive the other components of the imaging units 103Y, 103M, 103C such as the electron chargers 108Y, 108M, 108C, the exposing devices 110Y, 110M, 110C, the primary transfer rollers 114Y, 114M, 114C.

In the black imaging unit 103K, the photoreceptor 104K is exposed to form the electrostatic latent image which is elicited with the black toner. By rotation of the photoreceptor 4, the black toner image on the photoreceptor 104K is brought to the intermediate transfer belt 130, and then primarily transferred from the photoreceptor 104K onto the intermediate transfer belt 130.

After the primary transfer, the toner remained on the photoreceptor 104K is scraped off by the edge of the cleaning blade 116K for fully cleaning the surface of the photoreceptor 104K, and the rotation of the developing device 118K of the black imaging unit 103K is stopped.

During operation of the developing device 118K of the black imaging unit 103K, the secondary transfer roller 140 is applied with a potential of polarity opposite to that of the black toner.

The black toner image primarily transferred on the intermediate transfer belt 130 are brought to the secondary transfer region 141, while the paper 146 received in the feed cassette 144 is fed also to the secondary transfer region 141. Then, the black toner image is secondarily transferred onto the paper which is delivered downstream through the passage 150 to the fuser roller 156. Also, the fuser roller 156 fuses or fixes the black toner image on the paper 146 which is in turn ejected to the catch tray 164.

Then, the controller 172 controls some post-transfer steps such as the cleaning step of the intermediate transfer belt 130 which are similar to those for the color mode, and halts the photoreceptors 104Y, 104M, 104C, 104K and the intermediate transfer belt 130.

With the monochrome mode selected, the above-mentioned difference of the circumferential speeds between each of the photoreceptor 104K and the intermediate transfer belt 130 prevents the cohesive mass off the intermediate transfer belt 130 from shifting onto the photoreceptors 104Y, 104M, 104C, 104K, thereby causing less abrasion of the photoreceptor cleaning blades 116Y, 116M, 116C, 116K.

When forming color and monochrome images sequentially, the controller 172 switches from one of the color-mode and monochrome-mode driving motors 136, 138 to the other one after the whole toner image(s) onto the intermediate transfer belt 130 is secondarily transferred onto the paper. Also, after switching the driving motor, the controller 172 await a predetermined time enough for the stable circumferential speed of the intermediate transfer belt 130 to initiate forming the other mode image.

With use of the image forming apparatus 2 of the first embodiment, a first experiment was made in the color mode for determining the contribution for the prevention of the out-of-color-registration in accordance with the ratio ($V_{BC}/V_A$) of the circumferential speed of the intermediate transfer belt 30 ($V_{BC}$) to the circumferential speed of the photoreceptor 4 ($V_A$). Also, a second experiment was made in the monochrome mode for confirming the durability of the photoreceptor cleaning blade 16 when varying the ratio ($V_{BK}/V_A$) of the circumferential speed of the intermediate transfer belt 30 ($V_{BK}$) to the circumferential speed of the photoreceptor 4 ($V_A$).

<First Experiment>

The image forming apparatus 2 was used in the color mode, adjusting the ratio ($V_{BC}/V_A$) of the circumferential speed of the intermediate transfer belt 30 ($V_{BC}$) to the circumferential speed of the photoreceptor 4 ($V_A$) as 0.9913, 0.9934, 0.9954, 0.9983, 1.0000, 1.0017, and 1.0037, for evaluating, by visual observation, the preventing feature of the out-of-color-registration (OCR) in each of the ratios ($V_{BC}/V_A$).

As clearly indicated in Table 1, when the ratio ($V_{BC}/V_A$) of the circumferential speed of the intermediate transfer belt 30 ($V_{BC}$) to the circumferential speed of the photoreceptor 4 ($V_A$) was set as 0.9934, 0.9954, 0.9983, and 1.0000, the out-of-color-registration (OCR) was well prevented, and especially when the ratio ($V_{BC}/V_A$) was adjusted as 0.9954 and 0.9983, the excellent preventing feature of the out-of-color-registration was observed. However, when the ratio ($V_{BC}/V_A$) was set as 0.9913, 1.0017, and 1.0037, the preventing feature of OCR was determined as being not good and unacceptable.

TABLE 1

| | $V_{BC}/V_A$ | | | | | | |
|---|---|---|---|---|---|---|---|
| | 0.9913 | 0.9934 | 0.9954 | 0.9983 | 1.0000 | 1.0017 | 1.0037 |
| Prevention of OCR | No Good | Good | Excellent | Excellent | Good | No Good | No Good |

As the result of the first experiment, the ratio ($V_{BC}/V_A$) in a range between 0.9934 through 1.0000 prevents the out-of-color-registration, and the ratio ($V_{BC}/V_A$) in a range between 0.9954 through 0.9983 achieves the excellent preventing feature of the out-of-color-registration. Therefore, when the image forming apparatus 2 is used in the color mode, the ratio ($V_{BC}/V_A$) is preferably set in the range between 0.9934 through 1.0000, and more preferably in the range between 0.9954 through 0.9983. Thus, it is to be noted that in order to achieve the good preventing feature of OCR, the ratio ($V_{BC}/V_A$) should be in a certain range and not be less than the 0.9913, i.e., having a given lower threshold in the color mode.

<Second Experiment>

Similarly, the image forming apparatus 2 was used for reproducing the image in the monochrome mode on a plurality of papers one by one intermittently, with the ratio ($V_{BK}/$ $V_A$) of the circumferential speeds of the intermediate transfer belt 30 ($V_{BK}$) to the circumferential speeds of the photoreceptor 4 ($V_A$) adjusted also as 0.9913, 0.9934, 0.9954, 0.9983, 1.0000, 1.0017, and 1.0037. For each of the above ratios ($V_{BK}/V_A$), the lifetime of the photoreceptor cleaning blade 16 was determined as the sheet of papers when the undesired line due to the chipped portion of the edge thereof was found on the reproduced image. Thus, the photoreceptor cleaning blade 16 used beyond its lifetime has the chipped portion at the tip thereof, which typically has a width of about 100-200 μm in the direction of width of the blade and a length of about 40 μm in the direction extending from the proximal end to the distal end of the blade.

Figure 5:
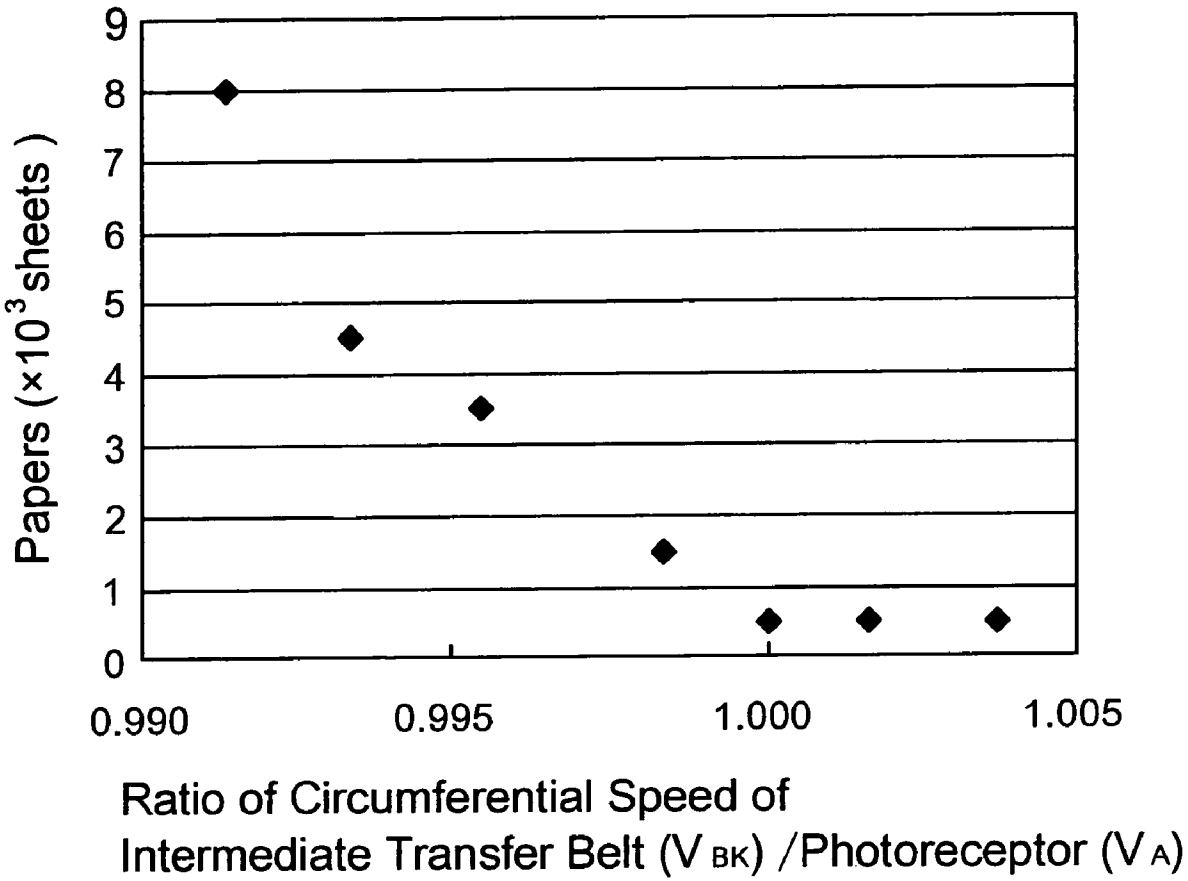
FIG. 5 is a graph of an experimental result showing the relationship between a ratio of a circumferential speed of an intermediate transfer belt to a circumferential speed of photoreceptor, and a durability of a photoreceptor cleaning blade.

As clearly shown in FIG. 5, when the ratio ($V_{BK}/V_A$) was set as 0.9983, 1.0000, 1.0017, and 1.0037, it was observed that the lifetime was shorter than 2,000 sheets of papers, meaning quite low durability of the photoreceptor cleaning blade 16. Also, when the ratio ($V_{BK}/V_A$) was adjusted as 0.9934 and 0.9954, the lifetime was more or less 4,000 sheets of papers, which is still required to be improved for its durability. Contrary, if the ratio ($V_{BK}/V_A$) was set as 0.9913 the lifetime was determined as about 8,000 sheets of papers, the sufficient durability of the photoreceptor cleaning blade 16 was achieved.

As the result of the second experiment, the ratio ($V_{BK}/V_A$) less than the 0.9934 fairly improves the durability of the photoreceptor cleaning blade 16. Also, it should be noted that the monochrome-mode ratio ($V_{BK}/V_A$) less than the 0.9934 favorable for improving the lifetime of the photoreceptor cleaning blade 16 is lower than the color-mode ratio ($V_{BC}/V_A$) in a range between 0.9934 through 1.0000 advantageous for the excellent preventing feature of the out-of-color-registration. Thus, the circumferential speed of the intermediate transfer belt 30 in the monochrome mode is less than that in the color mode with the constant circumferential speed of the photoreceptor 4. Therefore, the difference of the circumferential speeds in the monochrome mode between the photoreceptor 4 and the intermediate transfer belt 30 ($\Delta d_{BK}=|V_A-V_{BK}|$) is set to be greater than that in the color mode ($\Delta d_{BC}=|V_A-V_{BC}|$), i.e., $\Delta d_{BK}>\Delta d_{BC}$.

In the meanwhile, it has been confirmed that if the difference of the circumferential speeds between the photoreceptor 4 and the intermediate transfer belt 30 is more than 5% of the circumferential speed of the photoreceptor 4, then the primary transfer may improperly be performed. Thus, the ratio ($V_{BK}/V_A$) is preferably set to 0.9500 or more even in the monochrome mode. Therefore, according to the image forming apparatus 2 of the present invention, the ratio ($V_{BK}/V_A$) in the monochrome mode is preferably set within a range between 0.9500 through 0.9930.

What is claimed is:

1. An image forming apparatus, comprising:

an intermediate transfer member rotating at a first circumferential speed; and an image carrier capable of having a plurality of toner images formed thereon in turn, each of the toner images having a color different from one another, for transferring the toner images onto said intermediate transfer member, said image carrier rotating at a second circumferential speed;

wherein at least one of the first and second circumferential speeds are adjustable in accordance with a driving mode selected from a group consisting of a monochrome mode and a color mode, and wherein a first difference between the first and second circumferential speeds in the monochrome mode is greater than a second difference between the first and second circumferential speeds in the color mode.

2. The image forming apparatus according to claim 1, wherein the second circumferential speed is not less than the first circumferential speed; and wherein the first circumferential speed in the color mode is greater than the first circumferential speed in the monochrome mode.

3. The image forming apparatus according to claim 1, wherein the second circumferential speed is not greater than the first circumferential speed; and wherein the first circumferential speed in the color mode is less than the first circumferential speed in the monochrome mode.

4. The image forming apparatus according to claim 1, wherein in the monochrome mode, the first circumferential speed is less than the second circumferential speed.

5. The image forming apparatus according to claim 1, wherein in the color mode, a color-mode ratio of the first circumferential speed to the second circumferential speed falls within a range between 0.9934 through 1.0000, and wherein in the monochrome mode, a monochrome-mode ratio of the first circumferential speed to the second circumferential speed is less than 0.9934.

6. The image forming apparatus according to claim 5, wherein the color-mode ratio falls within a range between 0.9954 through 0.9983, and wherein the monochrome-mode ratio falls within a range between 0.9500 through 0.9934.

7. The image forming apparatus according to claim 1, wherein the second circumferential speed is constant while the first circumferential speed is adjustable in accordance with the driving mode.

8. The image forming apparatus according to claim 1, wherein the first circumferential speed is constant while the second circumferential speed is adjustable in accordance with the driving mode.

9. An image forming apparatus, comprising:

an intermediate transfer member rotating at a first circumferential speed; and a plurality of image carriers, each capable of having a toner image of a color different from one another, said color image carriers rotating at a second circumferential speed;

wherein the first circumferential speed is adjustable in accordance with a driving mode selected from a group consisting of a monochrome mode and a color mode, and wherein a first difference between the first and second circumferential speeds in the monochrome mode is greater than a second difference between the first and second circumferential speeds in the color mode.

10. The image forming apparatus according to claim 9, wherein the second circumferential speed is not less than the first circumferential speed; and wherein the first circumferential speed in the color mode is greater than the first circumferential speed in the monochrome mode.

11. The image forming apparatus according to claim 9, wherein the second circumferential speed is not greater than the first circumferential speed; and wherein the first circumferential speed in the color mode is less than the first circumferential speed in the monochrome mode.

12. The image forming apparatus according to claim 9, wherein in the monochrome mode, the first circumferential speed is less than the second circumferential speed.

13. The image forming apparatus according to claim 9, wherein in the color mode, a color-mode ratio of the first circumferential speed to the second circumferential speed falls within a range between 0.9934 through 1.0000, and wherein in the monochrome mode, a monochrome-mode ratio of the first circumferential speed to the second circumferential speed is less than 0.9934.

14. The image forming apparatus according to claim 13, wherein the color-mode ratio falls within a range between 0.9954 through 0.9983, and wherein the monochrome-mode ratio falls within a range between 0.9500 through 0.9934.

15. An image forming apparatus, comprising:

an intermediate transfer member rotating at a first circumferential speed;

a plurality of color image carriers, each capable of having a colored toner image of a color different from one another, said color image carriers rotating at a second circumferential speed; and a monochrome image carrier capable of having a monochrome toner image, said monochrome image carrier rotating at a third circumferential speed;

wherein the second and third circumferential speeds are adjustable in accordance with a driving mode selected from a group consisting of a monochrome mode and a color mode, and wherein a first difference between the first and third circumferential speeds in the monochrome mode is greater than a second difference between the first and second circumferential speeds in the color mode.

16. The image forming apparatus according to claim 15, wherein the second and third circumferential speeds are not less than the first circumferential speed; and wherein the second circumferential speed in the color mode is greater than the third circumferential speed in the monochrome mode.

17. The image forming apparatus according to claim 15, wherein the second and third circumferential speeds are not greater than the first circumferential speed; and wherein the second circumferential speed in the color mode is less than the third circumferential speed in the monochrome mode.

18. The image forming apparatus according to claim 15, wherein in the monochrome mode, the first circumferential speed is less than the third circumferential speed.

19. The image forming apparatus according to claim 15, wherein in the color mode, a color-mode ratio of the first circumferential speed to the second circumferential speed falls within a range between 0.9934 through 1.0000, and wherein in the monochrome mode, a monochrome-mode ratio of the first circumferential speed to the third circumferential speed is less than 0.9934.

20. The image forming apparatus according to claim 19, wherein the color-mode ratio falls within a range between 0.9954 through 0.9983, and wherein the monochrome-mode ratio falls within a range between 0.9500 through 0.9934.

* * * * *